United States Patent [19]

Vangsted et al.

[11] 4,314,141

[45] Feb. 2, 1982

[54] APPARATUS FOR HEAT SHRINKING A PLASTIC FILM AROUND GOODS STACKED ON A PALLET

[75] Inventors: Arne Vangsted; Ejner V. Sorensen, both of Nørre Åby, Denmark

[73] Assignee: Lip Bygningsartikler A/S, Nørre Åby, Denmark

[21] Appl. No.: 101,609

[22] Filed: Dec. 10, 1979

[30] Foreign Application Priority Data

Dec. 13, 1978 [DK] Denmark ..... 5584/78

[51] Int. Cl.[3] ..... B65B 53/02

[52] U.S. Cl. ..... 219/348; 219/354; 53/557

[58] Field of Search ..... 53/557, 440, 441, 442; 219/388, 348, 354; 198/793, 797; 34/4

[56] References Cited

U.S. PATENT DOCUMENTS

| | | | |
|---|---|---|---|
| 2,387,516 | 10/1945 | Kaminski | 219/354 |
| 2,841,684 | 7/1958 | Miskella | 219/354 |
| 3,615,003 | 5/1959 | Rust | 198/793 |
| 3,710,550 | 1/1973 | Osborne | 219/354 |
| 3,793,798 | 2/1974 | Lancaster et al. | 53/557 |

FOREIGN PATENT DOCUMENTS

| | | | |
|---|---|---|---|
| 2550036 | 5/1977 | Fed. Rep. of Germany | 53/557 |
| 677933 | 8/1952 | United Kingdom | 198/797 |

*Primary Examiner*—Gerald P. Tolin
*Assistant Examiner*—Bernard Roskoski
*Attorney, Agent, or Firm*—Lawrence Rosen

[57] ABSTRACT

In an apparatus for shrinking of a shrink film hood around goods stacked on a pallet, heat radiation elements and reflectors, serving to heat the film hood, are mounted in a gallow-shaped rod i.e. an inverted L-shaped carrier, with a U-shaped cross section. The said rod is suspended from an endless chain and can be moved around the stacked goods in a quadrangle movement, being guided in such manner that it turns 90° when a corner is passed in the quadrangular movement. A single round of the gallow-shaped rod gives the necessary heating of the shrink film hood.

4 Claims, 2 Drawing Figures

APPARATUS FOR HEAT SHRINKING A PLASTIC FILM AROUND GOODS STACKED ON A PALLET

Figure 1:
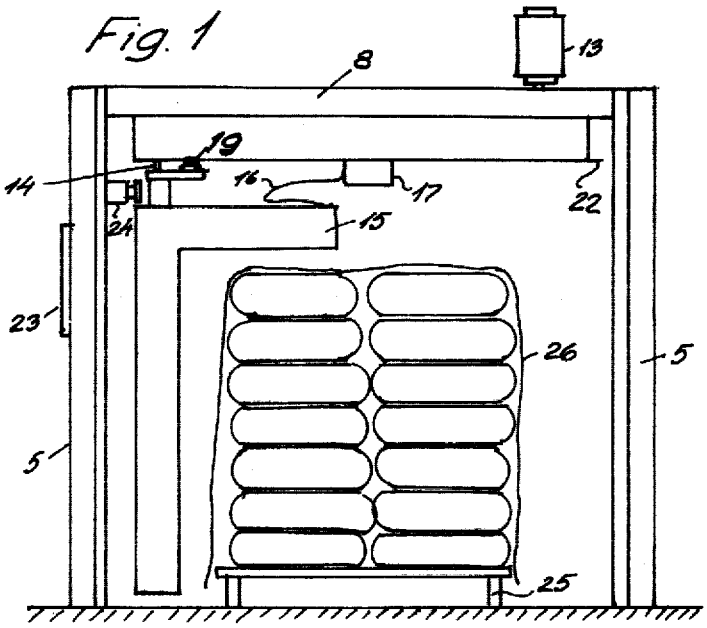

The invention relates to an apparatus for heat shrinking of a plastic film around goods stacked upon a pallet, in which apparatus the plastic film is heated by means of radiation heat elements.

The heating must be so vigorous that the film material is softened, and, to promote the heating, the film has often incorporated therein aluminium particles which reflect the radiation heat to the film material. When the heating has stopped, the film on cooling will shrink around the stacked goods and become stiffer so that it tightens around and supports the stacked goods.

According to the German publications DE-OS No. 2,153,001 and DE-OS No. 2,550,036 shrinking of a plastic film material around stacked goods is effected by blowing hot gasses against the film until it is sufficiently heated to shrink when cooled. The use of hot gas for the heating is disadvantageous in that the heat transmission is by convection, which means that only a small fraction of the heat contained in the hot gas can be transmitted during the short period of contact between the gas and the film with resulting great loss of energy. Also, the means for producing the hot gas complicates the apparatus.

Hot gas is also used for the shrinking as described in the U.S. Pat. No. 3,626,654, according to which the pallet is placed on a turntable which is first rotated for wrapping a plastic film around the goods, and then further rotated while subjecting the film to blasts of hot gas from a heating nozzle which is movable.

The Danish Pat. No. 132,019 relates to an apparatus for shrinking a plastic film around goods stacked on a pallet, the heating being by means of electric heat radiation elements which are mounted on the inside of a rectangular horizontally oriented frame which can be lowered to encircle the stacked goods which are covered by a hood of plastic film. Reflectors are mounted behind the heat radiation elements to direct a major part of the radiation obliquely downward. As stated in the specification, the varying distances to the different parts of the hood tend towards unequal heating which must be counteracted by varying the movement rate of the frame and turning some of the heat radiation elements off at times.

The present invention has for its object to provide an apparatus of the said kind which, at the same time being of a simpler construction and thus substantially cheaper than the known apparatusses, is of such design that it does not have the said disadvantages.

According to the invention, the heat radiation elements of the apparatus are mounted in the hollow space of a gallow-shaped carrier, i.e. an inverted L-shaped carrier of U-shaped cross-section having a long vertical part and a short horizontal part, of U-shaped cross-section opening against the film to be shrinked, said carrier being movably suspended and being guided in such manner that it can be made to encircle a pallet with stacked goods covered with a shrinkable film hood in a quadrangular horizontal movement, and to turn 90° around a vertical axis each time a corner is passed in the quadrangular movement.

Preferably, the heat radiation elements are quartz lamps mounted with a reflecting background, and the gallow-shaped carrier, i.e. an inverted L-shaped carrier, is moved by means of an electromotor. Thus, the apparatus only needs a supply of electric energy for its operation, and practical tests have shown that at 380 volts a maximum of 16 amperes is sufficient for its operation. Activation of the quartz lamps of the preferred type gives an infrared radiation of 3200 nanometers wave length, and one tour of the carrier around the pallet during 2 minutes is sufficient to effect the shrinking.

The quartz lamps are conveniently arranged in sections which can be activated singly or several sections together. Thus, if only the sides of the plastic hood are to be shrinked, the quartz lamps in the vertical part of the carrier are not activated or might even be omitted.

In a particularly simple embodiment of the present apparatus, according to the invention, the gallow-shaped carrier, i.e. an inverted L-shaped carrier, at its knee is suspended from a member connecting with an endless chain which is carried over horizontal sprockets placed in a quadrangle, and the carrier rests against a surrounding quadrangular guide rail by means of a three point ball guide, serving to turn the horizontal part of the carrier 90° when passing a corner in its quadrangular movement. The endless chain is driven in known manner by a motor through a gear, reducing the chain movement to a speed so low that the carrier has to pass only once around the goods to heat all of the plastic film hood sufficiently to effect the shrinking. The chain movement is started from a control panel, from which also the necessary number of heat radiation elements is activated, and the chain movement is interrupted by a transducer stop when the carrier has returned to its starting point after having passed once around the goods.

According to the invention, the connection between the gallow-shaped carrier, i.e. an inverted L-shaped carrier, and the endless chain is advantageously so designed that the distance between the carrier and the side wall can be adjusted to bring the carrier close to the plastic film hood to be shrinked.

This adjustability of the carrier also ensures that it can always be made to pass by at a suitable distance from the stacked goods, even if the goods, as it often occurs, project beyond the surface of the goods pallet.

Preferably, the apparatus comprises a pair of side walls connected at the top by stays to which the driving means and guiding means for the gallow-shaped carrier, i.e. an inverted L-shaped carrier, are affixed. In this manner, the apparatus can be made as a single movable unit, the total weight of which is below 100 kilograms, and is thus easily moved from one place of use to another. To facilitate such moving, the side walls can be provided with castors.

Alternatively, the apparatus can be stationary, and the pallet under treatment can be one of a number of pallets placed on a conveyor or a pair of conveyors, which are automatically started and stopped synchroneously with the termination and start, respectively, of the shrinking procedure.

If desired, the apparatus can also comprise two carriers placed opposite to one another, so that only half of one tour is needed for the shrinking, thus giving the apparatus double capacity.

Figure 2:
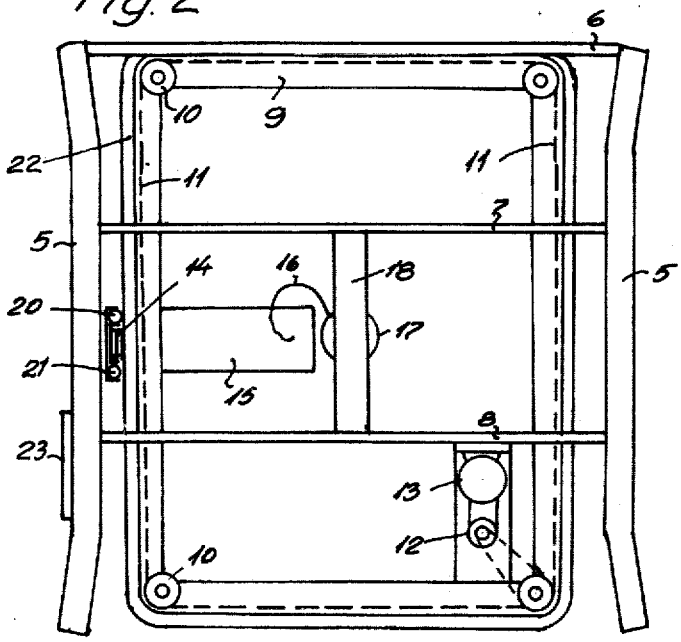

An embodiment of an apparatus according to the invention is shown in the accompanying drawing, in which FIG. 1 is a front view of the apparatus, and FIG. 2 shows the same seen from above.

The apparatus as shown is limited by two side walls 5 being interconnected and stayed at the top by stays 6, 7, and 8. Below these is horizontally suspended a substantially rectangular chain locker 9 having a sprocket 10 in each of the four corners. An endless chain 11 passes over the sprockets 10, one of which can be driven via a gear 12 by an electromotor 13.

In the chain 11, a gallow-shaped carrier, i.e. an inverted L-shaped carrier, 15 is suspended by means of a connecting member 14.

The carrier has an inward opening U-shaped cross-section, and in the hollow space quartz lamps and reflectors (not shown) are mounted.

Current supply to the quartz lamps takes place through a wire 16 in connection with a rotatable sliding contact box 17, which is mounted upon a rod 18 between stays 7 and 8.

The carrier 15 is kept in position and guided by means of a ball guide carrying three balls 19, 20, and 21, of which the ball 19 is in contact with the underside of the chain locker 9, whereas the balls 20 and 21 are in contact with a guide rail 22 extending all the way around the chain locker 9.

The apparatus is operated from a control panel 23, placed on the outside of one of the side walls 5, and from which there are wirings to the electromotor 13, to the contact box 17 and to a transducer stop 24, the function of which will be described below.

The wiring between the control panel 23 and the contact box 17 is designed so that the quartz lamps mounted in sections in the gallow-shaped rod 15 can be activated section-wise as desired.

The apparatus functions in the following way:

A pallet 25 with stacked goods, enclosed by a hood made from shrink film, is placed centrally within the apparatus. By pressing on a start button in the control panel 23, first the quartz lamps are activated and a bit later the electromotor 13 starts, and the chain 11 brings the carrier 15 into an even movement around the pallet. At the corners of the quadrangular movement performed by the carrier 15, the ball guide 19,20,21 together with the guide rail 22 ensures that the horizontal part of the carrier is turned 90° when passing a corner, so that this part always extends inward over the pallet with the stacked goods.

The strength of the irradiation is thus adjusted, having regard to the rate of movement of the gallow-shaped rod, i.e. an inverted L-shaped carrier, that a single passage is sufficient for heating the film hood to the necessary extent, and when the carrier 15 has completed its tour and passes by the transducer, the movement is interrupted, and the irradiation is stopped. The pallet 25 is then removed from the apparatus, and as the hood 26 gradually cools, it shrinks and tightens up around the stacked goods to secure the goods against sliding.

We claim:

1. An apparatus for heat shrinking a plastic film around goods stacked upon a pallet, comprising an inverted L-shaped carrier of U-shaped cross-section having a long vertical part and a short horizontal part in the hollow space of which electrical radiation heat elements are mounted, said carrier being movably suspended, and means being provided for making the carrier perform a quadrangular movement around a pallet with stacked goods covered by a hood made from shrinkable plastic film, and means serving to make the carrier turn 90° around a vertical axis when passing a corner in the quadrangular movement, so that the horizontal part of the inverted L-shaped carrier will always extend inward over the stacked goods during the movement.

2. An apparatus according to claim 1, in which the radiation heat elements are quartz lamps sectionally mounted on a reflecting background, and wired in known manner so that they may be activated individually or in groups.

3. An apparatus according to claim 1, in which the carrier is suspended, by means of an adjustable connection, from an endless chain which passes over horizontally placed sprockets arranged in a quadrangle, an electromotor being provided for driving one of the sprockets via a reduction gear, a three point ball guide, bearing with one ball against a locker for the endless chain and two balls against a guide rail around the chain locker, serving to make the carrier turn 90° on passing a corner in its quadrangular movement.

4. An apparatus according to claim 3, which is designed as a single, movable unit, having side walls interconnected by stays to the underside of which are attached the chain locker enclosing the endless chain from which the carrier is suspended, and the guide rail for guiding the carrier.

* * * * *